US006434761B1

(12) United States Patent
Wing et al.

(10) Patent No.: US 6,434,761 B1
(45) Date of Patent: Aug. 20, 2002

(54) PORTABLE SOAKING AND BATH PAN FOR TREATING PERINEAL WOUNDS

(76) Inventors: Betty G. Wing; Allen J. Wing, both of 1515 19th St. NE., Rochester, MN (US) 55906; Troy N. Wing, 701 Clay St., Mantorville, MN (US) 55955

( * ) Notice: Subject to any disclaimer, the term of this patent is extended or adjusted under 35 U.S.C. 154(b) by 0 days.

(21) Appl. No.: 09/750,528

(22) Filed: Dec. 29, 2000

(51) Int. Cl.[7] ..... E03C 1/20

(52) U.S. Cl. ..... 4/446; 4/443; 4/444; 4/621; 4/420.3

(58) Field of Search ..... 4/621, 622, 446, 4/443, 444, 450, 455, 420.3

(56) References Cited

U.S. PATENT DOCUMENTS

| | | | | | |
|---|---|---|---|---|---|
| 485,943 | A | * | 11/1892 | Jamison | 4/446 |
| 1,245,915 | A | * | 11/1917 | Herman | 4/446 |
| 3,039,117 | A | * | 6/1962 | Hoskins | 4/444 |
| 3,772,710 | A | * | 11/1973 | Coutellier | 4/621 |
| 5,361,427 | A | * | 11/1994 | Wilk | 4/443 |
| 5,381,562 | A | * | 1/1995 | Holloway et al. | 4/621 |

FOREIGN PATENT DOCUMENTS

| | | | | |
|---|---|---|---|---|
| CA | 657017 | * | 4/1970 | 4/446 |
| GB | 17289 | * | of 1910 | 4/621 |

* cited by examiner

*Primary Examiner*—Gregory L. Huson
*Assistant Examiner*—Khoa Huynh

(57) ABSTRACT

A portable soaking and bath pan is provided for treating perineal wounds of a bedridden patient. The pan comprises a bottom portion having a generally flat lower surface for being supported upon the patient's bed and upwardly and outwardly flaring sides that define a relatively wide and shallow treatment area that can receive the thighs and buttocks of the patient to be treated. A collection reservoir or basin is formed within the bottom portion immediately beneath the treatment area which is used to collect cleansing fluid as the patient is treated. The collection reservoir has a drain outlet that is used to convey the accumulated cleansing fluid from the reservoir through flexible tubing to a discharge receptacle in the patient's room. A discharge valve controls the flow of cleansing fluid from the reservoir. A handheld, detachable spray head mounted to the pan is provided for introducing cleansing fluid into the treatment area. A filling valve is provided in conjunction with the spray head for the purpose of controlling the flow of cleansing fluid into the treatment area through the spray head.

2 Claims, 2 Drawing Sheets

PORTABLE SOAKING AND BATH PAN FOR TREATING PERINEAL WOUNDS

BACKGROUND OF THE INVENTION

1. Field of the Invention

The present invention relates to a portable soaking and bath pan useful in the medical care and treatment of perineal wounds, such as pressure ulcers and bedsores, on patients who are bedridden or have a difficult time moving from the bed in which they are convalescing.

2. Description of the Prior Art

Patients who are bedridden quite often develop bedsores and/or pressure ulcers in the perineal area as a result of their continued confinement to the bed during the treatment of their primary medical condition. The occurrence of such wounds can complicate and prolong the patient's recovery.

It is well known that promoting and maintaining the hygienic condition of the perineal area is an important factor in preventing such wounds and in treating them once they do occur. This generally involves the cleaning and drying of the patient's perineal area. The optimum treatment regimen usually involves steps such as (1) placing the patient in a cleaning vessel such as a tub and filling the vessel with water or some other cleaning fluid, (2) cleaning the perineal area, (3) draining and discarding the cleaning fluid (i.e, water) from the vessel, (3) refilling the vessel with cleaning fluid and soaking the perineal area for a period of time, (4) draining and discarding the cleaning fluid in which the patient has been soaking, (5) refilling the vessel and again cleaning the perineal area, and (6) draining and discarding the cleaning fluid and thoroughly drying the patient.

One of the basic problems with this process in the case of bedridden patients, however, is that they are, by definition, unable to access conventional cleaning facilities such as bathtubs and showers conveniently.

Various devices have been developed over the years to facilitate the cleaning of the perineal area of such patients. These are typically in the nature of a sitz bath, which is a chair-like bathtub wherein the patient sits so as to immerse his/her thighs and hips in water or some other cleansing solution. The major problem with the prior art devices, however, is that, while some of them are portable and can be moved to the patient's bed, they still require that the patient get out of bed to use the device. This can be extremely difficult or even impossible with a large number of patients. Examples of the prior art devices include the following U.S. patents.

In U.S. Pat. Nos. 3,072,918; 3,102,273; 4,324,008; 4,326,308; 4,674,138; and 4,764,997, various types of sitz baths and related equipment are shown that are intended to be used in conjunction with a conventional (but fixed) toilet. In each case, of course, the patient must be moved from the bed to the location of the toilet.

U.S. Pat. Nos. 2,139,951; 3,902,200; and 5,459,887 all show portable sitz baths that can be moved to a more convenient location for the patient to access, but they all still require that the patient be moved from the bed to use the device.

In the case of large patients requiring assistance, or in the case of totally immobile patients, it is often necessary that more than one nurse or other medical personnel be available to assist in getting the patient out of bed and moving him/her from the bed to the cleaning device. Since staffing is often a problem, both in terms of cost and availability, this fact also presents a problem associated with many of the prior art devices.

U.S. Pat. No. 4,312,084 shows an inflatable bathtub which can be used at the patient's bed. This device, however, is cumbersome in operation and requires a source of air in order to inflate the support structure. In addition, the inflatability of the device dictates that it be constructed of a vinyl or other similar material that sacrifice durability for flexibility.

SUMMARY OF THE INVENTION

It is one object of the present invention to provide a portable soaking and bath pan that is useful in the treatment of perineal wounds such as bedsores and pressure ulcers of bedridden patients wherein such wounds can be treated without the patient getting out of bed.

It is another object of the present invention to provide a portable soaking and bath pan that is useful in the treatment of perineal wounds such as bedsores and pressure ulcers of bedridden patients that requires the assistance of only one health care assistant in order to treat such wounds.

It is another object of the present invention to provide a portable soaking and bath pan that is useful in the treatment of perineal wounds such as bedsores and pressure ulcers of bedridden patients that is sturdy and rigid while at the same time being light enough so as to be easily transportable by one person.

It is yet another object of the present invention to provide a portable soaking and bath pan this is useful in the treatment of perineal wounds such as bedsores and pressure ulcers of bedridden patients wherein such pan includes means for filling the pan and means for draining the pan while the pan is in use on the patient's bed.

It is still another object of the present invention to provide a printable soaking and bath pan that is useful in the treatment of perineal wounds such as bedsores and pressure ulcers of bedridden patients wherein spray means are included for rinsing the perineal area of the patient.

To those ends, a portable soaking and bath pan is provided that is designed such that the patient can be placed in the pan without getting out of bed. The pan is sized so as to be large enough to receive the thighs and buttocks of the patient, while at the same time being shallow enough so as to be easily slid under the patient with minimal movement of the patient. The pan is relatively wide and shallow to hold a sufficient amount of water or other cleaning fluid such that the perineal area of the patient can be cleaned and soaked while the patient is in the pan. A lower, central basin collects the cleaning fluid during the cleaning and soaking processes. The basin is provided with a drain such that the accumulated cleaning fluid can be drained from the pan without removing the patient from the pan. A spray nozzle detachably mounted to the pan is provided for connection to a water source as a means for filling the pan while the patient is in the pan.

DETAILED DESCRIPTION OF THE PREFERRED EMBODIMENT

Figure 1:
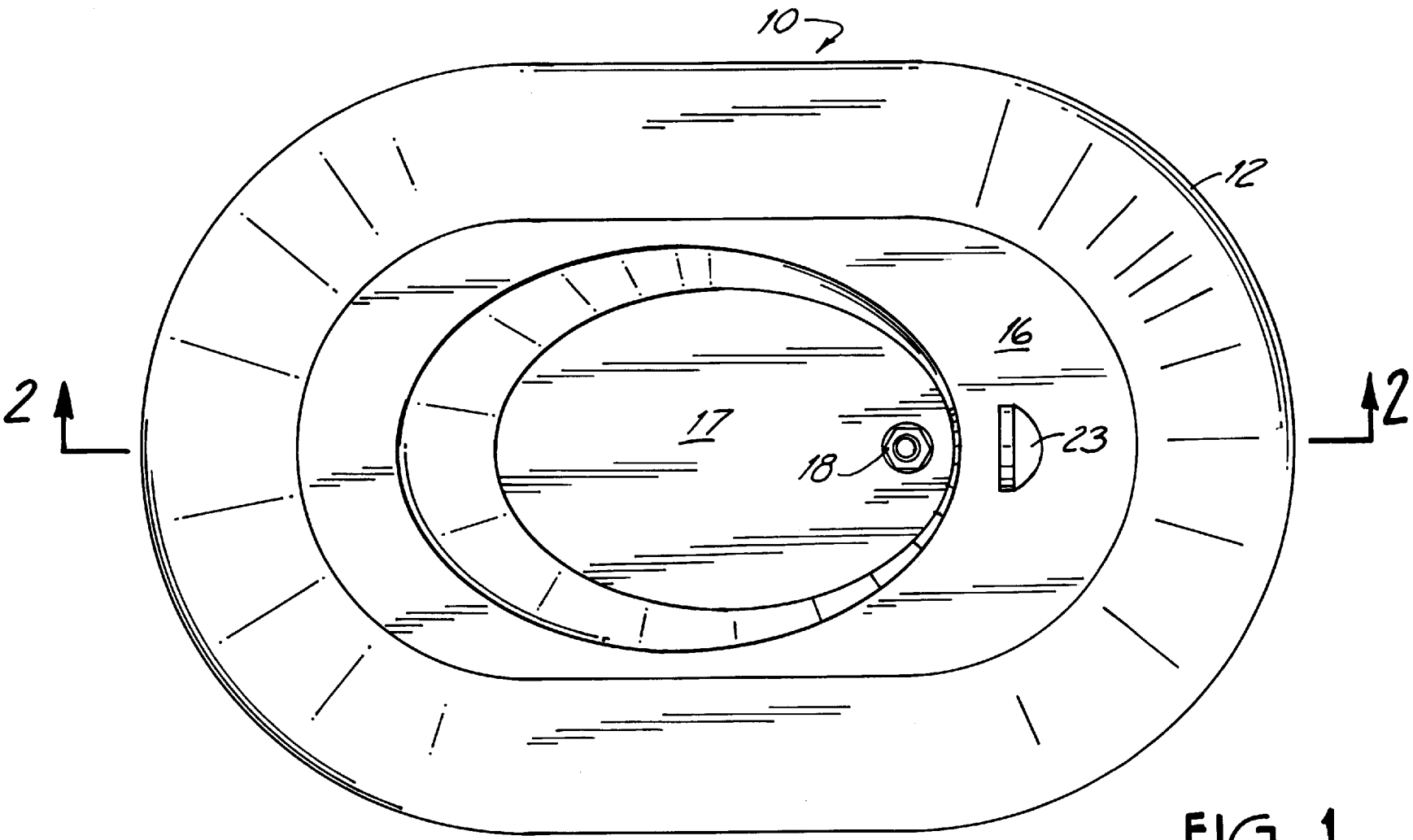
FIG. 1 shows a top elevational view of a soaking and bath pan according to the present invention.
Figure 2:
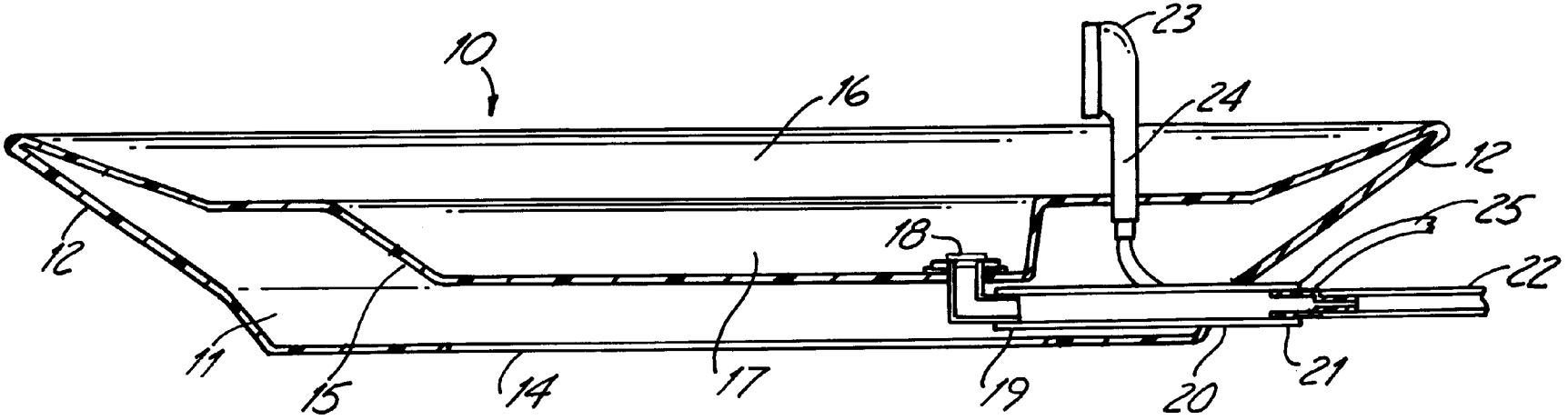
FIG. 2 shows a side sectional view of a soaking and bath pan according to the present invention.

Referring to the drawing, wherein like numerals represent like elements throughout the several views, there is shown a portable soaking and bath pan for treating perineal wounds generally designated by the numeral 10. The pan 10 is generally oval in shape when viewed from above and has a lower base portion 11 and upwardly and outwardly flaring sides 12. The bottom portion 11 has a flat, lower exterior surface 14 and an interior surface 15. The interior surface 15 and sides 12 define a treatment area 16 into which the patient's thighs and buttocks may be placed when the pan 10 is in use. The pan 10 is relatively shallow so as to facilitate it being slid under a patient while the patient remains in the bed, and relatively wide so as to receive the buttocks of the patient and to hold sufficient fluid to facilitate the cleansing and soaking of the perineal area of the patient. It has been determined that a width of approximately 24 inches, a length of approximately 36 inches and a depth of approximately 6 inches are adequate to provide a pan of sufficient dimensions to be useful in conjunction with most patients.

The bottom portion 11 defines a centrally positioned basin 17. The basin 17 is positioned such that it will underlie the perineal area of a patient that is placed in the pan 10 for treatment. The purpose of the basin 17 is to collect and remove cleaning fluid as the patient is being bathed. A drain 18 is provided in the lower portion of the basin 17. The drain 18 is connected to one end 19 of discharge conduit 20 formed within the bottom portion 11. The opposite end 21 of the discharge conduit 20 extends through the bottom portion 11 and is sized as to be connectable to flexible tubing 22 which can be used to carry discharged cleaning fluid from the pan 10 to a disposal receptacle such as a sink in the patient's room. Discharge valve means for opening and closing the drain 18 are also provided, but not shown. These may consist of any conventional valve means such as a stopper that can be placed in the drain 18 or a valve that can be placed at a convenient location at the exterior end 21 of the discharge conduit 20.

Fluid introduction means are provided for introducing cleansing fluid into the pan 10. In the preferred embodiment, the fluid introduction means comprise a spray head 23 positioned at the front of the basin 17. The spray head 23 has a handle 24 that seats within the pan 10 in the manner shown and can be removed therefrom to reposition the spray head 23 for effective application of the cleansing fluid. The end of the handle 24 opposite of the spray head 23 is attached to flexible tubing 25 which in turn can be attached to a source of cleansing fluid such as a faucet (not shown) or even a container (such as a bag) of cleaning fluid when a faucet is not conveniently located. Filling valve means for controlling the flow of fluid through the spray handle 24, such as a manually operable valve, may advantageously be provided. These can be any type of suitable convention valves. In addition, the spray head 23 may be of the pulsating type which delivers a pulsating jet of cleaning fluid to the wound site for better irrigation of the wound. As an alternative to a spray head 23, it will be seen that the fluid introduction means may also advantageously comprise a jet of water located in the basin 17 that directs a stream of water upwardly toward the patient.

In use, it will be seen that the pan 10 can be used by bedridden patients without the need to remove the patient from the bed. The pan 10 is preferably constructed of injection molded plastic and is thus light in weight and can be easily transported to the patient's bed. The lower exterior surface 14 of the pan 10 is supported upon the bed and the patient is lifted or moved such that his/her mid thigh to lower back area is located within the treatment area 16. The overall shape of the pan 10 is ergonomically designed so as to not place the patient's skin in the area to be treated into contact with any part of the pan 10. Once the patient is in place, the flexible tubings 22 and 25 are connected to a disposal receptacle and source of cleansing fluid, respectively. Initially, the drain 18 is kept open such that the cleaning fluid may drain from the basin 17. Fluid is introduced through the spray head 23 which is positioned in the manner best suited for applying the cleaning fluid to the patient to wash the perineal area. Once the cleaning process has been completed and the spent cleaning fluid drained from the basin 17, the discharge valve means can be closed. Further introduction of cleaning fluid will cause the pan 10 to fill to the level that the patient's perineal area can be soaked for the desired length of time. Once the pan 10 is filled to the desired level, the filling valve means are closed. Upon completion of the soaking process, the discharge valve means are opened to drain the soaking fluid and, once drained, the patient can be washed again the same manner described above. Thus, it will be seen that the pan 10 facilitates alternated cycles of washing and soaking without the patient having to leave his/her bed.

While we have described the preferred embodiment of our invention, it will be evident to those skilled in the art that there are other possible embodiments within the scope of our invention.

What is claimed is:

1. A portable soaking and bath pan for treating a patient's perineal wounds comprising:

(a) a bottom portion and upwardly and outwardly flaring sides, said bottom portion defining a bottom surface adapted to be supported upon a bed, and said bottom portion and said sides defining a treatment area sized to receive the thighs and buttocks of the patient;

(b) filling means for introducing cleansing fluid into said treatment area; and (c) a collection reservoir formed within said bottom portion of said pan beneath said treatment area to receive and collect cleansing fluid discharged from said treatment area, said collection reservoir having discharge valve means for controlling drainage of cleansing fluid from said reservoir;

wherein said filling means comprises a spray head mounted within said treatment area of said pan, wherein said spray head is adapted to be connected to a source of cleansing fluid.

2. A portable soaking and bath pan for treating a patient's perineal wounds comprising:

(a) a bottom portion and upwardly and outwardly flaring sides, said bottom portion defining a bottom surface adapted to be supported upon a bed, and said bottom portion and said sides defining a treatment area sized to receive the thighs and buttocks of the patient;

(b) filling means for introducing cleansing fluid into said treatment area;

(c) a collection reservoir formed within said bottom portion of said pan beneath said treatment area to receive and collect cleansing fluid discharged from said treatment area;

(d) a drain outlet in said reservoir being adapted to be connected to means for conveying discharged cleansing fluid from said reservoir; and (e) discharge valve means for controlling drainage of discharged cleansing fluid from said reservoir through said drain outlet;

wherin said filling means comprises a nozzle having a discharge end mounted within said treatment area, wherein said nozzle is adapted to be connected to a source of cleansing fluid.

* * * * *